US007216725B2

(12) United States Patent
Jacobs et al.

(10) Patent No.: US 7,216,725 B2
(45) Date of Patent: May 15, 2007

(54) SOIL SAMPLING SYSTEM AND METHOD THAT ALLOW HEADSPACE SCREENING AT SPACED INTERVALS WITHOUT DISTURBING SOIL SAMPLE

(75) Inventors: Lloyd E. Jacobs, Green Bay, WI (US); David E. Turriff, Green Bay, WI (US); John F. Schabron, Laramie, WY (US); Susan S. Sorini-Wong, Laramie, WY (US); Thomas M. Christy, Salina, KS (US)

(73) Assignees: En Novative Technologies, Inc., Green Bay, WI (US); Kejr Inc., Salina, KS (US)

( * ) Notice: Subject to any disclaimer, the term of this patent is extended or adjusted under 35 U.S.C. 154(b) by 294 days.

(21) Appl. No.: 11/042,996

(22) Filed: Jan. 24, 2005

(65) Prior Publication Data

US 2005/0126824 A1 Jun. 16, 2005

Related U.S. Application Data

(63) Continuation-in-part of application No. 10/456,800, filed on Jun. 6, 2003.

(60) Provisional application No. 60/387,041, filed on Jun. 6, 2002.

(51) Int. Cl.
*E21B 49/02* (2006.01)

(52) U.S. Cl. ..... 175/20; 175/58; 175/249; 73/864.51; 73/864.64; 73/864.91

(58) Field of Classification Search ..... 175/20, 175/58, 226, 249, 308; 73/863, 864, 864.51, 73/864.64, 864.91

See application file for complete search history.

(56) References Cited

U.S. PATENT DOCUMENTS

| | | | | |
|---|---|---|---|---|
| 230,121 | A * | 7/1880 | Frost | 73/863.31 |
| 3,077,979 | A * | 2/1963 | Jones et al. | 206/523 |
| 4,587,857 | A * | 5/1986 | Bush | 73/863 |
| 4,982,615 | A * | 1/1991 | Sultan et al. | 73/864.51 |
| 5,209,129 | A * | 5/1993 | Jaselskis et al. | 73/864.64 |
| 5,307,884 | A * | 5/1994 | Millgard | 175/20 |
| 5,454,020 | A * | 9/1995 | Solazzi | 378/45 |

FOREIGN PATENT DOCUMENTS

DE 4200426 A1 * 7/1993

* cited by examiner

*Primary Examiner*—Kenneth Thompson
(74) *Attorney, Agent, or Firm*—Jeffrey L. Thompson; Thompson & Thompson, P.A.

(57) ABSTRACT

A soil sampling system is provided that allows headspace screening of soil samples at spaced intervals along a soil sample liner without disturbing the soil samples to be collected and shipped to a laboratory for further testing. The soil sample liner includes a plurality of cylindrical liner sections positioned end-to-end in a linear array, with each liner section having a sidewall and open ends. A shrink-wrap material covers the liner sections and holds the liner sections together as an assembled unit. Some of the liner sections have access openings formed in a sidewall thereof for providing access to the soil samples contained therein. The liner sections having access openings are interspersed between other liner sections that do not have access openings. The access openings are used by piercing the shrink-wrap material covering the access opening, and inserting a probe tip through the access opening into a headspace to measure contamination.

20 Claims, 5 Drawing Sheets

SOIL SAMPLING SYSTEM AND METHOD THAT ALLOW HEADSPACE SCREENING AT SPACED INTERVALS WITHOUT DISTURBING SOIL SAMPLE

RELATED APPLICATIONS

This application is a continuation-in-part of U.S. Utility patent application Ser. No. 10/456,800 filed on Jun. 6, 2003, which claims priority of U.S. Provisional Application No. 60/387,041 filed on Jun. 6, 2002.

BACKGROUND OF THE INVENTION

1. Field of the Invention

The present invention relates generally to devices for obtaining soil samples from below the surface of the ground. In particular, the present invention relates to soil sampling systems that allow access to a portion of the soil core for headspace screening without violating the integrity of the remaining soil core, and soil sample containment devices used to protect soil samples after the samples are collected by the soil sampling system.

2. Description of the Related Art

Soil sampling systems are commonly used to obtain soil samples from below the surface of the ground. The collected soil samples are used to determine soil conditions prior to construction, to locate mineral deposits, to study chemical dissipation and residue, to determine the concentration of environmental contaminants, to investigate hazardous waste sites, and in other ways well known in the art.

Unfortunately, the equipment and methodology for collecting and preserving soil samples do not allow for consistent and accurate soil analysis. It is common practice to retrieve a soil sample from the subsurface via a soil sampler, remove the soil sample from the soil sampler, and place the sample in a separate container. During this process, the handling and exposure of the soil sample increases the loss of contaminants which may be contained within the soil sample.

The existing process involves a user taking a core section of soil, cutting open the tube, screening the whole length of the tube for contamination vapors, and if the contamination is not high, putting that core section aside and going on to the next one until the user finds the highest level of contamination. The user cannot be sure which one has the highest contamination until all of the cores have been screened. In the meantime, the exposed soil samples of the open cores are volatilizing and the integrity of the soil samples is deteriorating.

For accurate soil analysis, it is important that the sample be collected without disruption of the soil structure, that the sample not be subsampled, and that the sample is sealed in a manner to prevent leaks of contaminants around the seal. This is particularly difficult when soil is being tested for contamination by volatile organic compounds (VOC) because the VOCs tend to volatilize when exposed to air. The sample should be isolated from air to maintain substantially the same level and type of contamination as when the sample was first cored from the earth. The ideal soil sample is one that is representative of its origin in the subsurface.

SUMMARY OF THE INVENTION

An object of the present invention is to provide an improved soil sampling system and sample containment device that overcome the problems and shortcomings of the prior art.

A further object of the present invention is to provide an improved soil sampling system that allows access to the soil core sample for headspace screening at spaced intervals, that minimizes the handling and exposure of soil samples in the field, and that better maintains the integrity of the soil sample.

A further object of the present invention is to provide an improved soil containment device that can be used effectively to preserve soil samples with minimal handling and disturbance, and that is economical to manufacture and easy to use.

A further object of the present invention is to provide a soil containment system that allows soil samples to be sealed and maintained within individual liner sections of a soil sampler liner without requiring subsampling.

A further object of the present invention is to provide an improved soil sampler liner that includes a plurality of liner sections having different lengths and/or materials corresponding to particular tests to be performed.

In order to accomplish these and other objects of the invention, a soil sampling system is provided that allows headspace screening of soil samples at spaced intervals along a soil sample liner without disturbing the soil samples that will be shipped to a laboratory for further testing. The soil sample liner includes a plurality of cylindrical liner sections positioned end-to-end in a linear array, with each liner section having a sidewall and open ends. A shrink-wrap material covers the liner sections and holds the liner sections together as an assembled unit. Some of the liner sections have access openings formed in a sidewall thereof for providing access to the soil samples contained therein. The liner sections having access openings are interspersed between other liner sections that do not have access openings. The liner sections without access openings can be used as part of a soil sample containment device by covering the respective ends of each liner section with first and second end caps. The access openings can be used during soil sampling operations by piercing the shrink-wrap material covering the access opening, removing some soil from within the liner section through the access opening to form a headspace, and inserting an analytical probe tip through the access opening into the headspace to measure contamination in the headspace air.

According to a broad aspect of the present invention, a soil sample liner is provided for use in a soil sampling system, comprising: a plurality of liner sections positioned end-to-end in a linear array, the liner sections each having a sidewall and open ends; a shrink-wrap material covering the plurality of liner sections and holding the liner sections together as an assembled unit; and at least one of the liner sections having an access opening formed in a sidewall thereof for providing access to a soil sample contained therein without disturbing a soil sample in an adjacent one of the liner sections.

According to another broad aspect of the present invention, a soil sample liner for use in a soil sampling system is provided in combination with a soil sample containment device. The soil sample liner comprises: first and second liner sections positioned end-to-end in a linear array, the liner sections each having a cylindrical sidewall and open ends; a shrink-wrap material covering the liner sections and holding the liner sections together as an assembled unit; and the first liner section having an access opening formed in the sidewall thereof for providing access to a soil sample contained therein without disturbing a soil sample contained in the second liner section.

According to another broad aspect of the present invention, a method of collecting soil samples is provided, comprising the steps of: providing a soil sample liner comprising at least first and second liner sections positioned end-to-end in a linear array, the liner sections each having a cylindrical sidewall and open ends, the first liner section having an access opening formed in the sidewall thereof for providing access to a soil sample contained therein without disturbing a soil sample contained in the second liner section, and a shrink-wrap material covering the liner sections and holding the liner sections together as an assembled unit; collecting a core soil sample within the soil sample liner; and screening the soil sample contained within the first liner section by piercing the shrink-wrap material covering the access opening, removing some soil from within the first liner section through the access opening to form a headspace, and inserting an analytical probe tip through the access opening into the headspace to measure contamination in the headspace air.

Numerous other objects of the present invention will be apparent to those skilled in this art from the following description wherein there is shown and described a preferred embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

Figure 1:
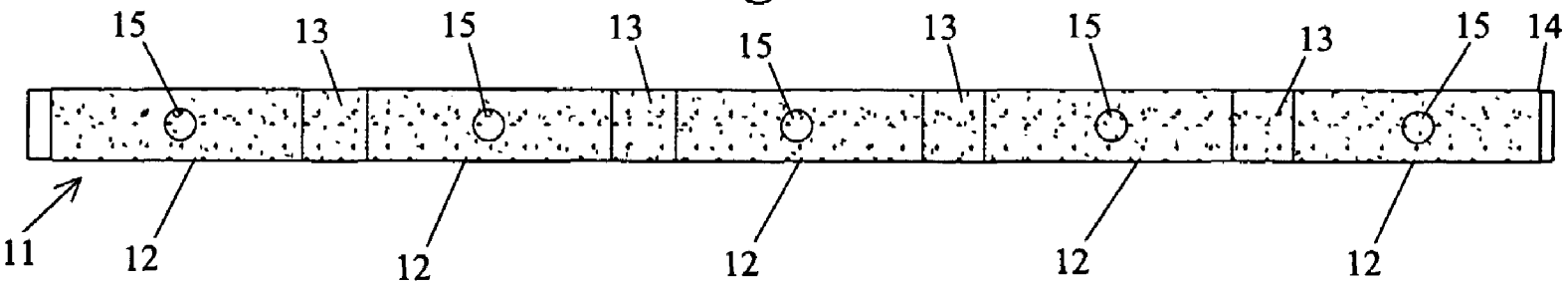
FIG. 1 is a side view of a complete soil sampler liner set according to the present invention with a shrink wrap covering.
Figure 2:
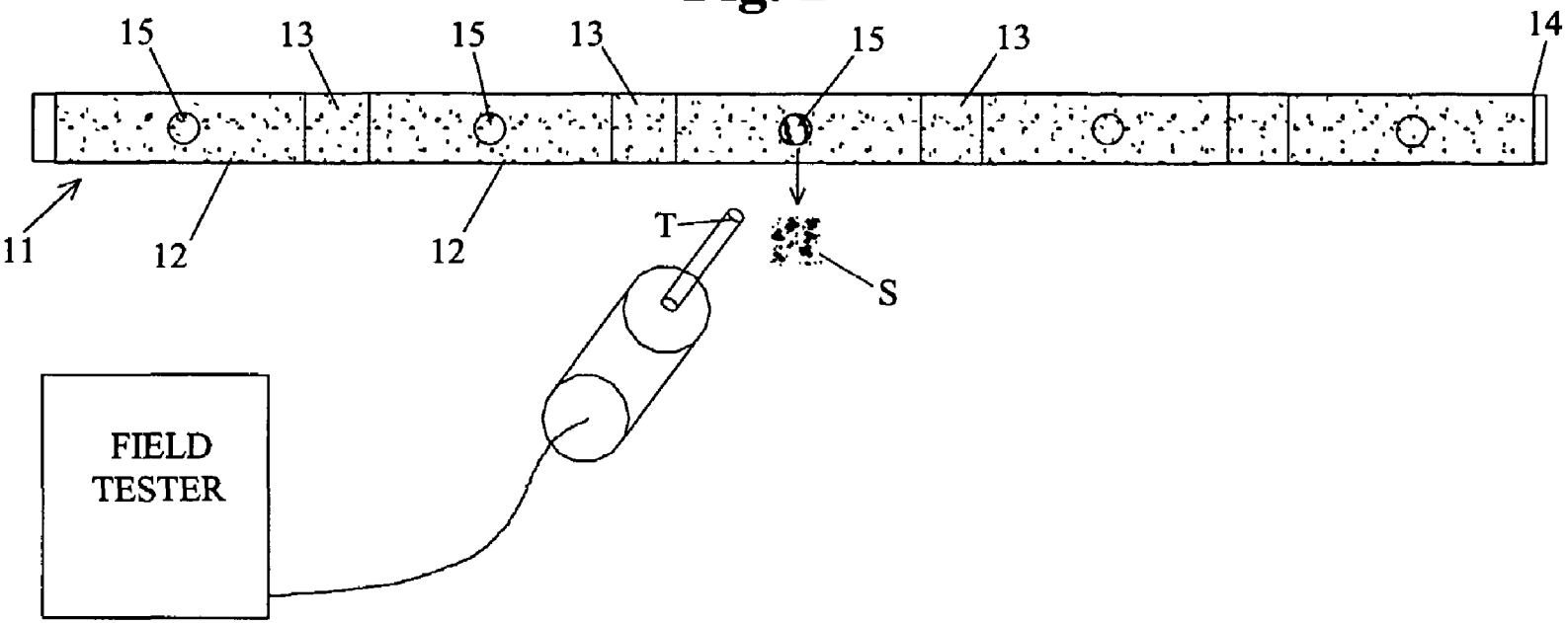
FIG. 2 is a side view of the soil sampler liner set with an opening in a sidewall of one of the sections being used to provide access to the soil core for headspace screening.
Figure 3:
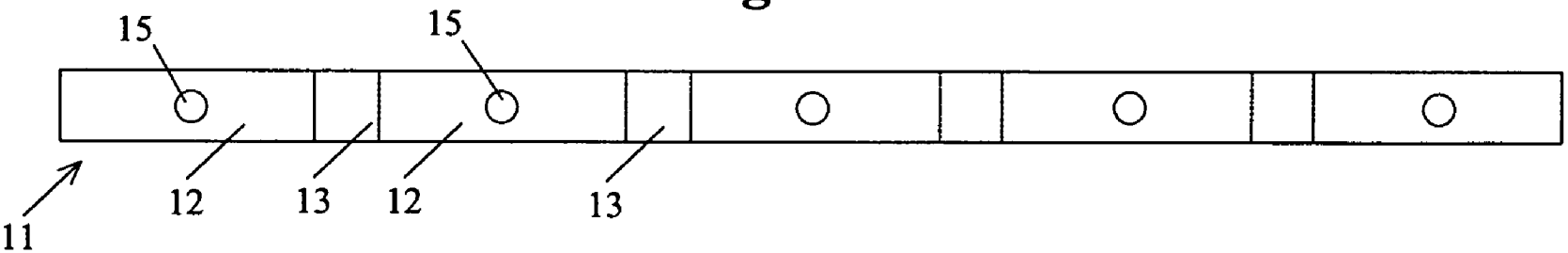
FIG. 3 is a side view of the soil sampler liner shown in FIG. 1 with the shrink wrap covering removed.
Figure 4:
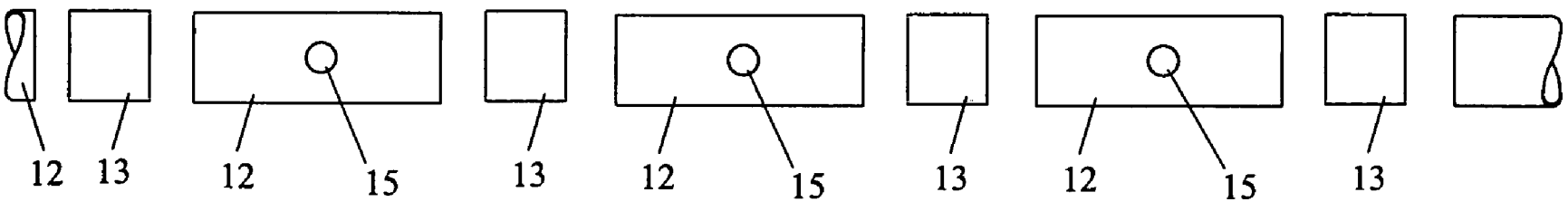
FIG. 4 is an exploded side view showing the individual sections of the soil sampler liner of FIG. 3.
Figure 6:
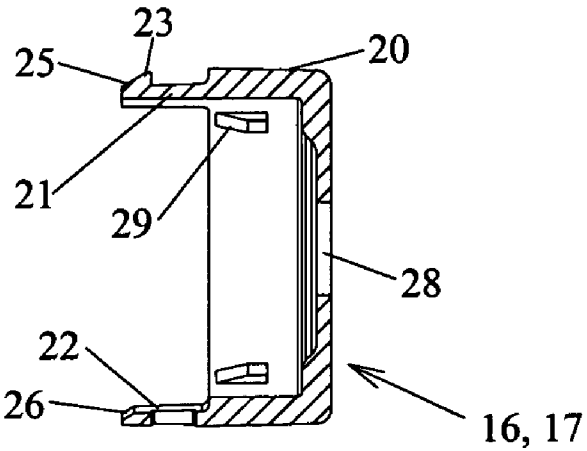
FIG. 6 is a cross section view of the end cap taken along line A—A in FIG. 5.
Figure 5:
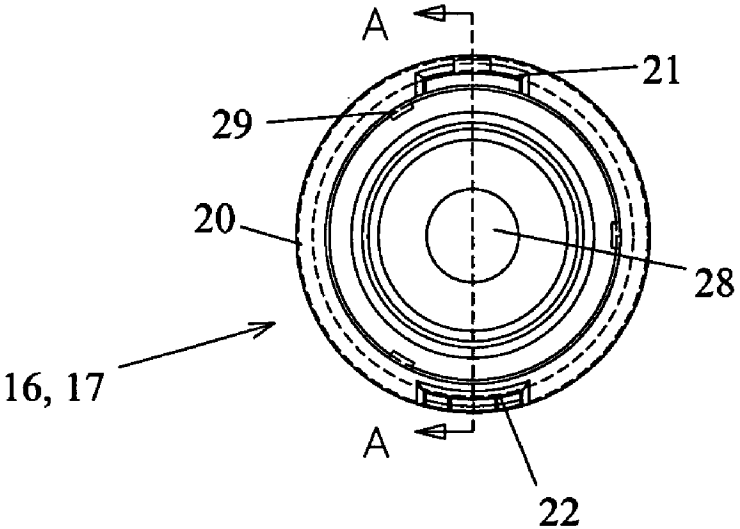
FIG. 5 is a plan view of an end cap of the soil sample containment device of the present invention.
Figure 8:
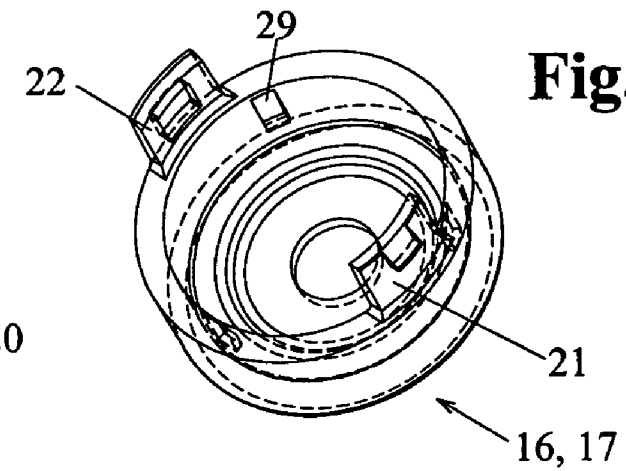
FIG. 8 is a perspective view of the end cap.
Figure 7:
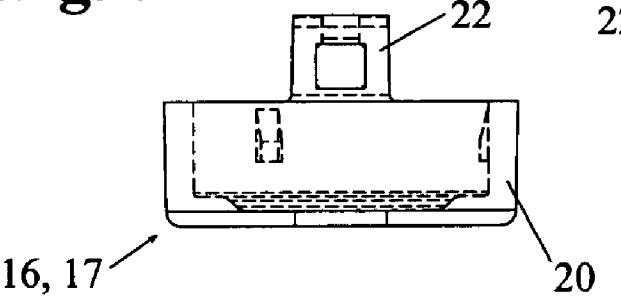
FIG. 7 is a side view of the end cap.
Figure 9:
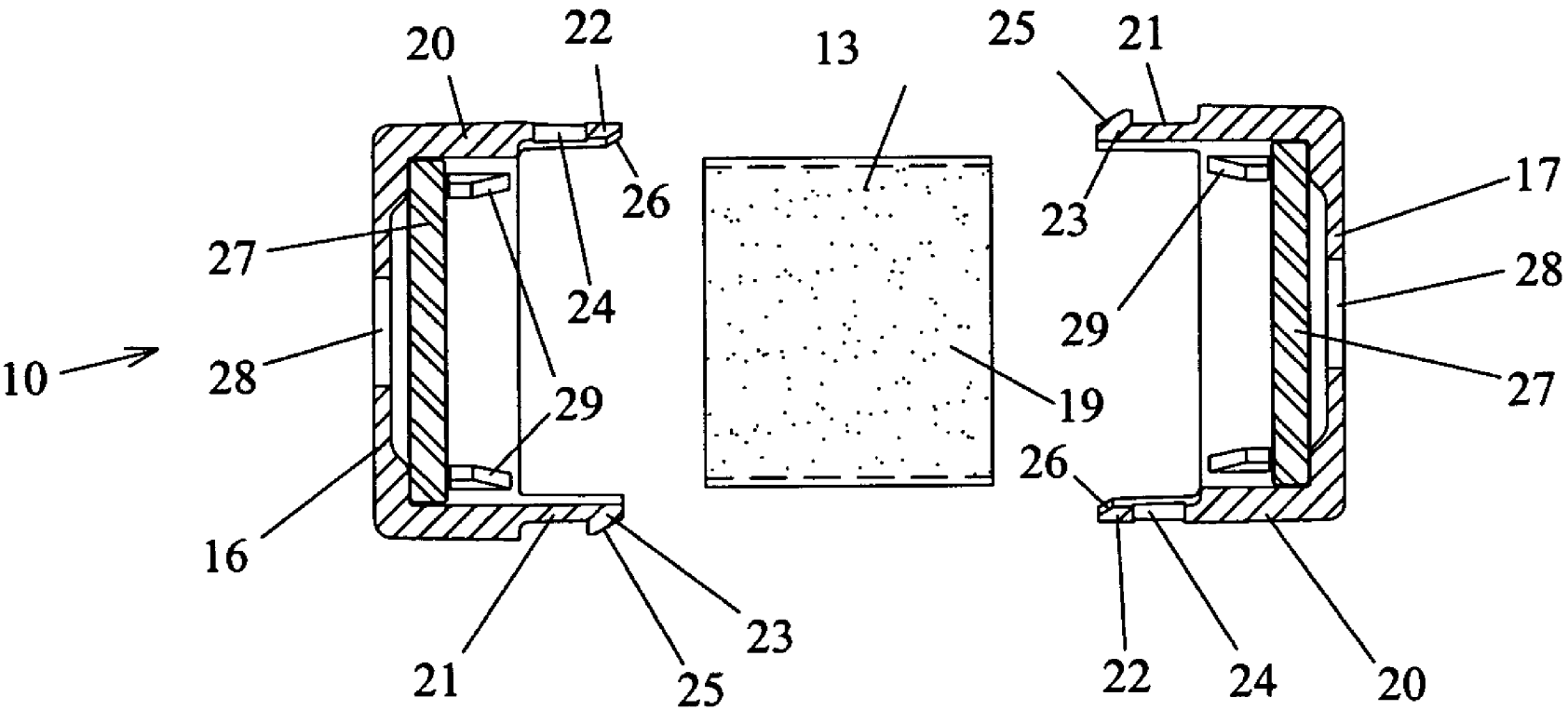
FIG. 9 is a side view of the soil sample containment device of the present invention before the end caps are assembled over the soil sampler liner section.
Figure 10:
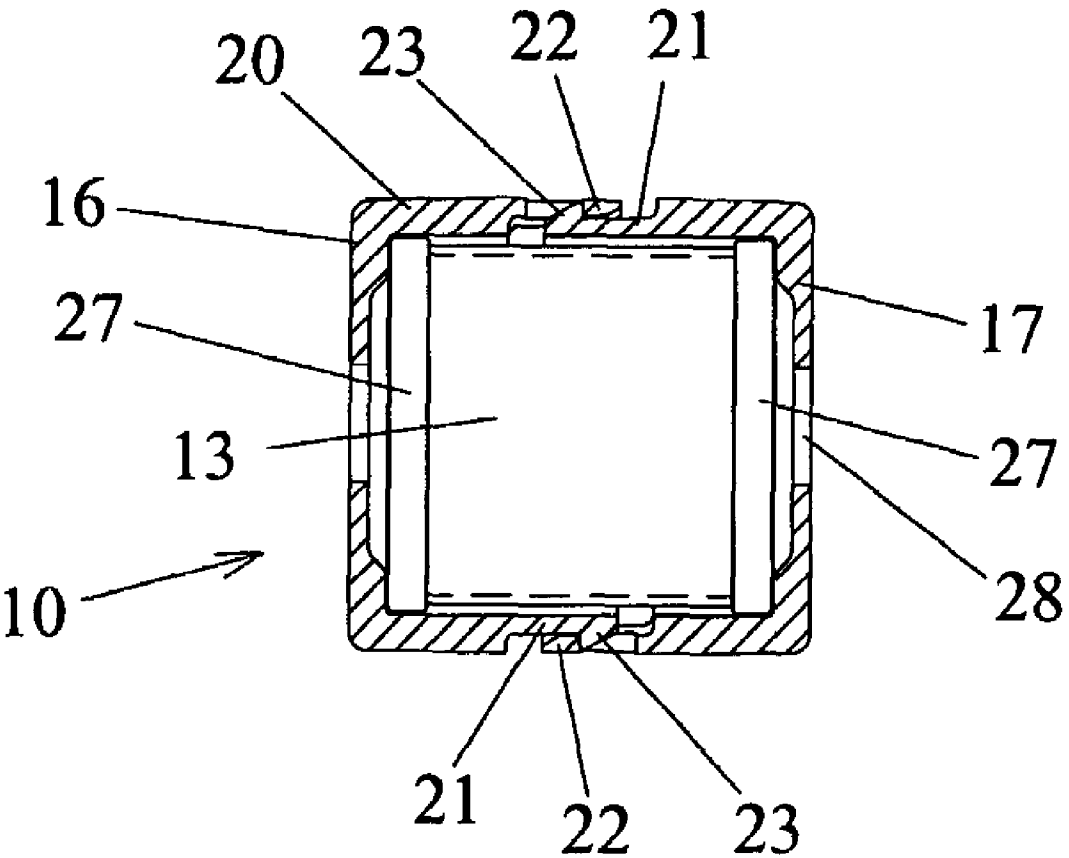
FIG. 10 is a side view of the soil sample containment device with the end caps assembled over the soil sampler liner section.

A soil sample liner 11 and soil sample containment device 10 according to a preferred embodiment of the present invention will now be described with reference to FIGS. 1 to 10 of the accompanying drawings.

The soil sample liner 11 of the present invention is an improvement over the soil sample liner described in the Applicants' parent application Ser. No. 10/456,800, while the containment device 10 of the present invention is the same as previously described.

The soil sampler liner 11 has several individual liner sections 12, 13 formed of cylindrical tubing, as shown in FIGS. 1 to 4. In the preferred embodiment, some of the liner sections 12 are plastic and some of the liner sections 13 are metal. A linear array of the liner sections 12, 13 are assembled end-to-end and held together as an assembled unit with a shrink-wrap material 14 covering the liner sections 12, 13. The liner sections 12, 13 will normally be assembled together and shrink-wrapped at the place of manufacture and transported to the field site as assembled units.

The plastic liner sections 12 are each provided with an access opening 15 formed in a sidewall thereof for providing access to a soil sample contained within the liner section 12. As shown in FIG. 1, the liner sections 12 with access openings 15 are positioned at spaced intervals along the soil sample liner 11, and the liner sections 13 without access openings are interspersed between the liner sections 12. The access openings 15 in the liner sections 12 are preferably circular in shape and have a diameter of about 0.25 to 0.5—inch, but a variety of other shapes and sizes can also be used. The access openings 15 are preferably formed at an approximate midpoint along a length of the liner sections 12 so that soil samples within the adjacent liner sections 13 are not disturbed by screening the soil through the access openings 15. The exact location of the access openings 15 along the length of the liner sections 12, 13 is not critical, as long as the access opening 15 is spaced a sufficient distance (e.g., about one inch or more) from the adjacent sections 13 so that the integrity of the soil sample is not disturbed.

The liner sections 12 are made of a transparent material that allows visual inspection of the soil sample at spaced locations along the soil sampler liner 11 before the liner 11 is cut open and disassembled. A suitable material for the transparent liner sections 12 is plastic, and particularly PETG. The ability to view the soil sample allows the user to avoid areas in the soil sample that may contain voids or other unwanted media. It also allows the user to observe possible changes in soil type or strata before disassembling the soil sampler liner 11.

At least some of the liner sections 13 without access openings are preferably made of metal, and particularly stainless steel. Some of the liner sections 13 can also be made of plastic or other nonmetallic materials. The use of both plastic and metal liner sections may be advantageous because it allows a wider variety of standard tests to be performed on the sampled soil, particularly when the liner sections 13 themselves are used as part of the soil sample containment device 10, as described below.

The complete soil sampler liner 11 is made up of a series of long soil sampler liner sections 12 and shorter soil sampler liner sections 13. The shorter liner sections 13, for example, can be one inch in length to hold approximately 25 grams of soil, or 1.25 inches in length to hold approximately 30 grams of soil. These particular sizes correspond with the soil mass requirements used in most soil tests performed in the United States. The American Society for Testing and Materials (ASTM), the U.S. Environmental Protection Agency (US EPA), and other federal and state governing bodies have adopted various standard soil tests that typically require a certain mass (e.g., 25 or 30 grams) of soil to be used to conduct the tests. Other countries, such as Japan, have adopted different standards for testing that call for different masses of soil (e.g., 50 grams). With the present invention, the liner sections 13 can be sized to provide a particular volume that corresponds with the desired mass of soil called for by a particular test.

A combination of liner sections 12, 13 can be used such that, when assembled, the combined length of the liner sections 12, 13 corresponds with the length of the soil sampler being used (e.g., 24", 36", 48", etc.). The use of both short and long liner sections 12, 13 allows for many soil sampler liner combinations.

In operation, the soil sample liner 11 of the present invention is used in conjunction with a sampling probe to collect a core soil sample within the liner 11. The soil sample contained within the liner 11 can then be visually inspected through the transparent liner sections 12 to check for strata changes or obvious pollution staining. The collected soil sample can then be screened at multiple, spaced locations along a length of the liner 11 using the access openings 15 in the liner sections 12. The screening process includes piercing the shrink-wrap material 14 covering the access opening 15, removing a small amount of soil S from within the respective liner section 12 through the access opening 15 to form a headspace within the liner section 12, and inserting a tip T of an analytical probe of a field tester (e.g., a photo ionization detector meter) through the access opening 15 into the headspace to measure contamination in the headspace air. The contamination in the headspace air, which is caused by contaminants from the soil volatilizing into the headspace air, is directly correlated with the contamination of the soil sample.

The core sample is thus kept intact, except for the small amount of soil S removed through the access opening 15 to create a headspace for the probe tip T. Once the screening process is completed for the soil sample liner 11, the liner 11 can be set aside or stored on ice while other core samples are collected and screened. The user can then go back and decide which one(s) of the several liner sections 13 to collect samples from for further testing at a laboratory. The selected liner sections 13 can be removed from the soil sample liner 11 by cutting open and removing the shrink-wrap material 14 from the soil sample liner 11 and scraping both ends of the selected liner section 13 with a spatula or the like. The liner section 13 can then be assembled into a soil containment device 10, as explained below, for transporting the soil sample to a laboratory for further testing without losing volatiles or otherwise disturbing the integrity of the soil sample.

The soil containment device 10 includes first and second locking end caps 16, 17 for covering and sealing the respective ends 18, 19 of a single soil sampler liner section 13. Each end cap 16, 17 has a cylindrical portion 20 with a coupling structure comprising two locking arms 21, 22 extending from an outer circumference. The cylindrical geometry of the locking end caps 16, 17 accommodates the cylindrical soil sampler liner section 13.

The two locking arms 21, 22 include a single hook arm 21 and a single eye arm 22. The hook arm 21 of the first end cap 16 can be coupled with the eye arm 22 of the second end cap 17, and vice versa, to secure the end caps 16, 17 together over the ends 18, 19 of the liner section 13. The hook arm 21 of each end cap 16, 17 has a wedge-shaped hook 23 protruding outwardly from its outer surface. When assembled, the wedge-shaped hook 23 is held in an outward fashion by the outer surface of the soil sampler liner section 13 to prevent inadvertent removal of the locking end caps 16, 17 from the soil sampler liner section 13.

The eye arm 22 of each end cap 16, 17 has one or two eyes or rectangular-shaped holes 24 that receive the wedge-shaped hook 23 of the hook arm 21 of the opposing end cap 16, 17. Multiple eyes or holes 24 in the eye arm 22 can be used to accommodate soil sampler liner sections 13 having different lengths, such as one inch and 1.25 inch lengths. The ends 25, 26 of the eye arm 22 and the hook arm 21 are chamfered such that the arms 21, 22 slide past one another rather than butt up to one another during assembly.

A flexible sealing material 27 is positioned within each end cap 16, 17 for providing a compression seal over a respective end 18, 19 of a soil sampler liner section 13. The flexible sealing material 27, also referred to as a "septum," preferably comprises a silicone substrate and a thin Teflon™ coating. The coupling structure provided by the arms 21, 22 of the end caps 16, 17 is such that a predictable spacing will exist between the end caps 16, 17 when they are assembled over a liner section 13 and coupled together (using a properly selected eye opening 24 if multiple openings are provided in the eye arm 22). As a result, the end caps 16, 17 can be made to properly compress the flexible sealing material 27 over the ends of the soil sampler liner section 13 with a highly predictable amount of compression.

The construction of the hook arms 21 and the eye arms 22 is such that the flexible sealing material 27 will not be over compressed or under compressed, thereby improving the integrity of the sample. Research by the Applicants has shown that under compression of the sealing material 27 does not create an adequate seal, while over compression can cause the sealing material 27 to be ruined and become difficult to secure. The latching mechanism provided by the hook arms 21 and the eye arms 22 has been designed to apply a designated predetermined loading to the sealing material 27. When the user inserts the latching mechanism to its proper end point, achieving closure, the compressible sealing material 27 is placed under the correct loading against the end 18, 19 of the liner section 13 to achieve the desired compression seal.

Other flexible materials or combinations of flexible materials can also be used for the sealing material 27 as long as they create a flexible and nonpermeable compression seal with the ends 18, 19 of the soil sample liner section 13. As used in this application, the phrase "compression seal" means any seal created by compressing one member against another member in a manner sufficient to prevent loss of volatiles from a soil sample. Other forms of compression seals, such as annular sealing rings, can be used instead of the septa described above.

Each end cap 16, 17 includes a relief opening 28 to allow for any small protrusions at the ends of the soil sample. The relief opening 28 allows the flexible sealing material 27 to flex outwardly and accommodate any protrusions without compromising the sealing effect of the device.

Each end cap 16, 17 also includes a plurality of centering tabs 29 to center a soil sampler liner section 13 within the cylindrical portion 20 of the end cap 16, 17. The centering tabs 29 are tapered at their leading edges to guide the ends of the liner section 13 into a centered position.

The first and second end caps 16, 17 have a substantially identical structure and can be interchanged end-to-end when being assembled over a soil sampler liner section 13. This allows a single inventory of end caps 16, 17 to be used and eliminates any hassle of having to find a male component to match a female component, and so forth.

In operation, the soil sample containment device 10 of the present invention is assembled by placing two locking end caps 16, 17 over the respective ends 18, 19 of a soil sampler liner section 13 and fastening or snapping the hook arms 21 together with the opposing eye arms 22. This assembly seals both ends of the soil sampler liner section 13, thereby preventing loss of the soil sample or contaminants contained within the soil sample. To disassemble the soil sample containment device 10, both eye arms 22 on the locking caps 16, 17 must be physically pulled outward to uncouple from the wedge-shaped hooks 23 of the hook arms 21 and thereby release the locking coupling structure of the end caps 16, 17.

An important advantage of the soil containment device 10 of the present invention over other related devices is the relationship between the soil sampler liner 11 and the locking end caps 16, 17. Other soil sample containers require excessive exposure and handling of the soil sample before it is actually sealed within a soil sample container. The present invention eliminates a substantial amount of the exposure and handling. In addition, the locking mechanism of the locking end caps 16, 17 essentially guarantees that the soil sample integrity will be preserved until the soil sample containment device 10 is disassembled.

Another important advantage of the soil containment device 10 of the present invention is that the soil sampler liner sections can be made in appropriate lengths to provide a volume of soil that corresponds closely with the mass required for a particular soil test. As a result, the invention eliminates the time consuming and expensive step of sub-sampling (i.e., collecting a small soil sample from a larger soil sample) within the laboratory to obtain the desired mass of soil for a particular soil test.

A method of containing soil samples using the soil containment device 10 described above will now be explained. The method uses a soil sampler liner assembly having at least one liner section, and preferably uses the soil sampler liner assembly 11 having a plurality of liner sections 13. A soil sample is collected within the liner sections 13 in a known manner using a soil sampling system, for example, that drives a soil sampler into the subsurface. The soil sampler liner assembly 11 is then removed from the soil sampling system and cut apart to separate the individual liner sections 13 from each other. The liner sections 13 (or at least one of them) are then sealed at their respective ends by end caps that form compression seals at the ends of the liner section, as described above, to prevent loss of volatiles from the soil sample. At least one of the liner sections has a predetermined volume corresponding to a mass of soil required for a standard test. As a result, substantially all of the soil sample from this liner section can be extruded in the laboratory for the test without subsampling.

It will be appreciated that certain features of the present invention described above can be changed without departing from the scope of the invention. For example, the soil sampler liner 11 may incorporate a core catcher or soil check valve to assist in sampling soil from the subsurface. Also, different sizes of soil sampler liner sections 12, 13 and locking end caps 16, 17 may be developed. Also, structures other than the mating hook and eye structures of the preferred embodiment can be used to couple the end caps 16, 17 together. For example, an external lever or screw clamp separate from the end caps themselves can be used to secure the end caps together over the ends of the liner section.

While the invention has been specifically described in connection with specific embodiments thereof, it is to be understood that this is by way of illustration and not of limitation, and the scope of the appended claims should be construed as broadly as the prior art will permit.

What is claimed is:

1. A soil sample liner for use in a soil sampling system, comprising:

a plurality of liner sections positioned end-to-end in a linear array, said liner sections each having a sidewall and open ends;

a shrink-wrap material covering said plurality of liner sections and holding said liner sections together as an assembled unit; and at least one of said liner sections having an access opening formed in a sidewall thereof for providing access to a soil sample contained therein without disturbing a soil sample in an adjacent one of said liner sections.

2. The soil sample liner according to claim 1, wherein said plurality of liner sections comprises a first plurality of liner sections with access openings formed in a sidewall thereof and a second plurality of liner sections without access openings formed in a sidewall thereof.

3. The soil sample liner according to claim 2, wherein said first plurality of liner sections are positioned at spaced intervals along said soil sample liner, and said second plurality of liner sections are interspersed between said first plurality of liner sections.

4. The soil sample liner according to claim 1, wherein said at least one liner section having said access opening is made of a transparent material that allows visual inspection of the soil core within the liner.

5. The soil sample liner according to claim 4, wherein said transparent material is plastic.

6. The soil sample liner according to claim 4, wherein said transparent material is PETG.

7. The soil sample liner according to claim 1, wherein said plurality of liner sections comprises at least one stainless steel liner section without an access opening formed in a sidewall thereof and at least one transparent liner section with an access opening formed in a sidewall thereof.

8. The soil sample liner according to claim 1, wherein said access opening is circular.

9. The soil sample liner according to claim 1, wherein said access opening is formed at an approximate midpoint along a length of said at least one liner section.

10. The soil sample liner according to claim 1, wherein said plurality of liner sections comprises at least one liner section without an access opening which has an interior volume corresponding to an amount of soil to be used in a standard soil test.

11. The soil sample liner according to claim 1, wherein said plurality of liner sections are cylindrical.

12. In combination, a soil sample liner for use in a soil sampling system and a soil sample containment device, the soil sample liner comprising:

first and second liner sections positioned end-to-end in a linear array, said liner sections each having a cylindrical sidewall and open ends;

a shrink-wrap material covering said liner sections and holding said liner sections together as an assembled unit; and said first liner section having an access opening formed in the sidewall thereof for providing access to a soil sample contained therein without disturbing a soil sample contained in said second liner section.

13. The combination according to claim 12, wherein said soil sample containment device comprises:

first and second end caps for covering respective ends of said second liner section after the second liner section is separated from the first liner section; and sealing means associated with the end caps for sealing respective ends of the second liner section with a compression seal to prevent loss of volatiles from a soil sample contained within the second liner section.

14. The combination according to claim 12, wherein said soil sample containment device comprises first and second end caps for covering respective ends of the second liner section after the second liner section is separated from the first liner section, each end cap comprising a structure for coupling with the opposite end cap for securing the end caps together when assembled over the liner section.

15. A method of collecting soil samples, comprising the steps of:

providing a soil sample liner comprising at least first and second liner sections positioned end-to-end in a linear array, said liner sections each having a cylindrical sidewall and open ends, said first liner section having an access opening formed in the sidewall thereof for providing access to a soil sample contained therein without disturbing a soil sample contained in said second liner section, and a shrink-wrap material covering said liner sections and holding said liner sections together as an assembled unit;

collecting a core soil sample within said soil sample liner; and screening the soil sample contained within said first liner section by piercing said shrink-wrap material covering said access opening, removing some soil from within said first liner section through said access opening to form a headspace, and inserting an analytical probe tip through said access opening into said headspace to measure contamination in the headspace air.

16. The method according to claim 15, further comprising the steps of:

removing the shrink-wrap material from the soil sample liner; and placing first and second end caps over the ends of said second liner section and forming a compression seal at each end of the second liner section to prevent loss of volatiles from the soil sample contained therein.

17. The method according to claim 15, wherein a plurality of liner sections having access openings formed therein are provided at spaced locations along a length of the soil sample liner, and said screening step is performed at multiple locations along the length of the soil sample liner.

18. The method according to claim 17, further comprising the steps of:

removing the shrink-wrap material from the soil sample liner; and placing end caps over the ends of selected liner sections which do not have access openings formed therein to prevent loss of volatiles from the soil samples contained within the selected liner sections while the soil samples are transported to a laboratory for further testing.

19. The method according to claim 17, wherein said plurality of liner sections having access openings are made of transparent material to allow visual inspection of the soil sample contained therein without disturbing an integrity of the soil sample.

20. The method according to claim 15, wherein said second liner section has an interior volume corresponding to a mass of soil required for a standard test, and further comprising the step of extruding substantially all of the soil sample from the second liner section for said test without subsampling.

* * * * *